US008365434B2

(12) United States Patent
Carow et al.

(10) Patent No.: US 8,365,434 B2
(45) Date of Patent: Feb. 5, 2013

(54) DISPENSING DRYER DOSING SENSING

(75) Inventors: James P. Carow, Saint Joseph, MI (US); Ryan R. Bellinger, Saint Joseph, MI (US); Francesco Jatta, Brescia (IT)

(73) Assignee: Whirlpool Corporation, Benton Harbor, MI (US)

( * ) Notice: Subject to any disclaimer, the term of this patent is extended or adjusted under 35 U.S.C. 154(b) by 77 days.

(21) Appl. No.: 12/971,634

(22) Filed: Dec. 17, 2010

(65) Prior Publication Data

US 2011/0083338 A1 Apr. 14, 2011

Related U.S. Application Data

(63) Continuation of application No. 12/166,352, filed on Jul. 2, 2008, now abandoned.

(51) Int. Cl.
*F26B 21/06* (2006.01)
*F26B 21/08* (2006.01)

(52) U.S. Cl. ..... 34/357; 34/389; 34/391; 34/395; 34/491; 34/492; 34/597

(58) Field of Classification Search ..... 34/357, 34/380, 389, 390, 391, 393, 394, 395, 443, 34/486, 491, 492, 493, 497, 498, 524, 562, 34/565, 597
See application file for complete search history.

(56) References Cited

U.S. PATENT DOCUMENTS

| | | | | |
|---|---|---|---|---|
| 6,998,380 | B2 * | 2/2006 | Fry et al. | 510/519 |
| 7,047,663 | B2 | 5/2006 | Zhang et al. | |
| 7,059,065 | B2 | 6/2006 | Gerlach et al. | |
| 7,066,412 | B2 | 6/2006 | Conley et al. | |
| 2006/0150437 | A1 | 7/2006 | Tarnowski et al. | |
| 2007/0163098 | A1 | 7/2007 | Tomasi et al. | |

FOREIGN PATENT DOCUMENTS

WO 03/102291 A2 12/2003

* cited by examiner

*Primary Examiner* — Jiping Lu
(74) *Attorney, Agent, or Firm* — Clifton G. Green; McGarry Bair PC

(57) ABSTRACT

A method for controlling the operation of a dryer comprising dispensing a treating chemistry from a dispensing system into a treating chamber of the dryer based on an output from the environmental drying sensor.

11 Claims, 3 Drawing Sheets

DISPENSING DRYER DOSING SENSING

CROSS-REFERENCE TO RELATED APPLICATIONS

The present application is a continuation of U.S. application Ser. No. 12/166,352, filed Jul. 2, 2008, and which is incorporated by reference herein in its entirety.

BACKGROUND OF THE INVENTION

Dispensing dryers are an uncommon type of clothes dryer which perform all of the traditional dryer functions in addition to dispensing a treating chemistry, which may be water and/or one or more chemistries, onto a load of laundry during a drying cycle of operation. The first dispensing dryers dispensed water, which was often used as part of a dewrinkling cycle. The dispensing was time-based, which often led to over-application or under-application of the needed amount of chemistry. In most cases, as the chemistry was water, the inability to provide the right amount of chemistry was not detrimental to the clothes. Any failing in the amount of water dispensed could be addressed by redoing the dispensing cycle if too little water was dispensed and the clothes were not sufficiently de-wrinkled, or by increasing the drying time if too much water was dispensed.

In the future, it may be desirable to have the dispensing dryers dispense more specialized chemistries. These chemistries may include water, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents. These dispensing dryers could have a dedicated dispensing system with its own dedicated sensors specifically tailored or selected for the chemistry to be dispensed. For these dedicated dispensing systems, it would be desirable that the right amount of chemistry be dispensed as too little will not have the desired treating effect and too much may be detrimental to the clothes.

SUMMARY OF THE INVENTION

A method for controlling the operation of a clothes dryer having a treating chamber, an environmental drying sensor for sensing an environmental condition in the treating chamber and used to control the drying of the clothes, a controller operably coupled to the environmental drying sensor for controlling a drying cycle based on the sensed environmental condition, and a dispensing system for dispensing treating chemistry to the treating chamber, the method comprising: heating the laundry in the treating chamber to either an activation or effective temperature for a treating chemistry to be dispensed into the treating chamber; transmitting an output from the environmental drying sensor based on an environmental condition in the treating chamber; and upon the laundry reaching the either the activation or effective temperature, dispensing the treating chemistry from the dispensing system into the treating chamber based on the output from the environmental drying sensor.

DESCRIPTION OF AN EMBODIMENT OF THE INVENTION

The invention is directed to using the traditional environmental sensors, e.g. a wetness sensor and exhaust temperature sensor used to control the drying of clothes in a traditional clothes dryer, to control the dispensing of treating chemistry in a dispensing dryer. The traditional drying sensors had not been used to control dispensing in the past or were not thought to be sufficiently precise or robust enough for the purpose. For example, in the first dispensing dryers that used time-based dispensing, i.e. the treating chemistry was dispensed for a certain time, the drying sensors were not used for controlling the amount and manner of dispensing of the treating chemistry. In the more recent dispensing dryers with dedicated dispensing systems, which have dedicated sensors, specialized sensors were used rather than the traditional drying sensors.

It has been discovered that the traditional sensors, while configured for drying the clothes, may be used to control the amount and manner treating chemistry dispensed in the dryer. While these sensors are not specifically configured to sense the dispensed chemistry, it has been found that they are good enough for many treating chemistries. That is, while their use to control dispensing will not necessarily result in the proper amount of treating chemistry being dispensed, any over-dispensing or under-dispensing will be sufficiently minor and will not result in damage to the clothes, nor will the final treating result be ineffective.

Figure 1:
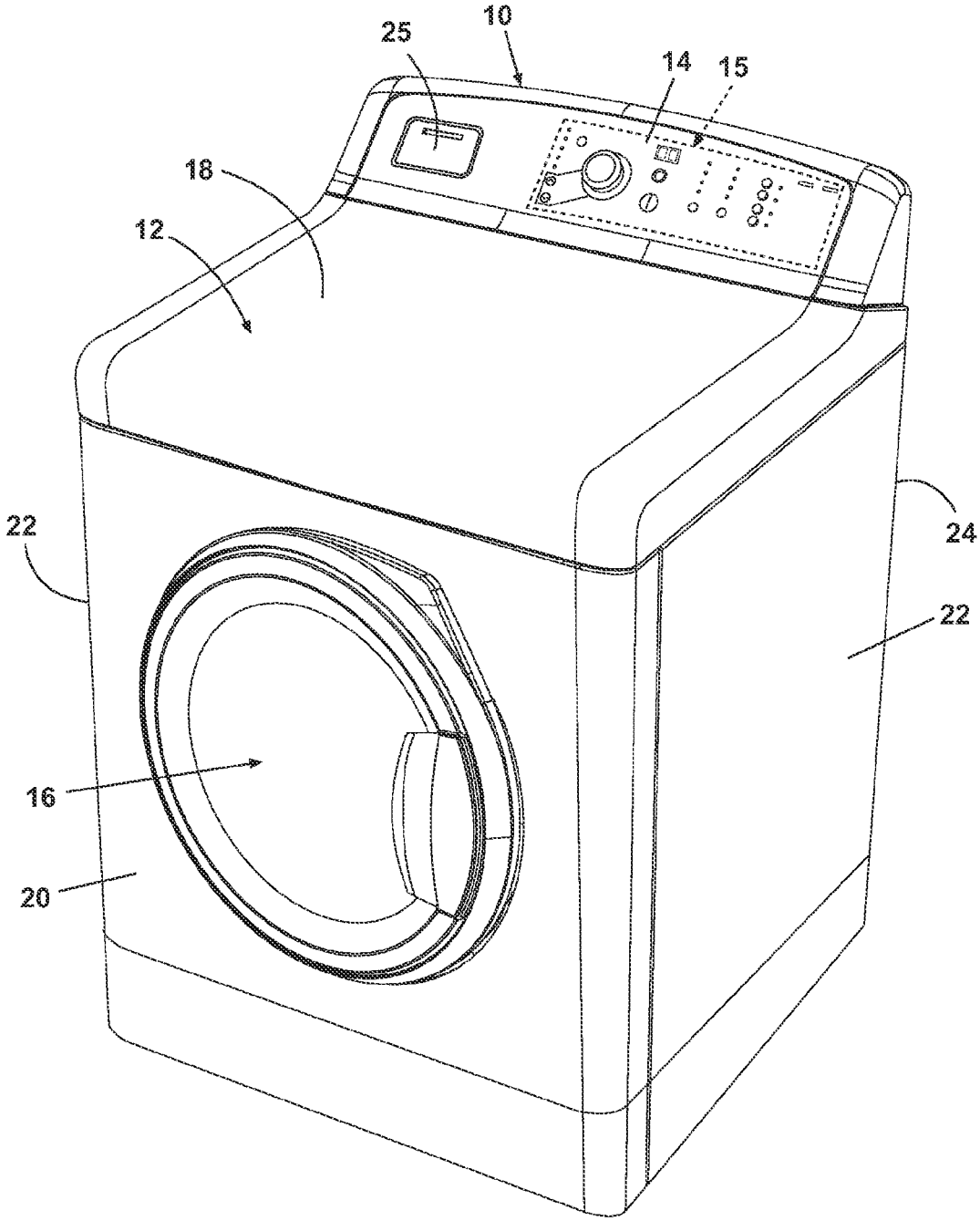
FIG. 1 is a perspective view of a dispensing dryer having its operation controlled by the method according to one embodiment of the invention.

Referring to FIG. 1, an embodiment of a dispensing dryer 10 according to one embodiment of the invention is illustrated including a cabinet 12 having a control panel 14 linked to a controller 15 (FIG. 2) for controlling the operation of the dryer 10. The cabinet 12 may be further defined by a door 16 hingedly attached to a front wall 20 of the cabinet 12, a rear wall 24, and a pair of side walls 22 supporting a top wall 18. The control panel 14 may have any number of features common to a control panel 14, including but not limited to a power button, dryer status indicator lights, parameter adjusting buttons and dials, a display, and start and stop buttons. These features may be marked with appropriate indicia to indicate their function. Selecting the cycle of operation may require a user to manipulate several of these features to initiate operation and specify parameters of the cycle of operation. Examples of such parameters include, but are not limited to cycle type, treatment type, heat level, wetness level, air level, temperature, and cycle or process length. The door 16 may include a sensing device (not shown) to ensure that the dispensing dryer 10 will not perform a cycle of operation if the door 16 is not closed. A lid 25 providing access to a dispensing system 26 (FIG. 2) may be built into the cabinet next to the control panel 14. The dispensing dryer 10 described herein shares many features of a well-known automatic clothes dryer, and will not be described in detail except as necessary for a complete understanding of the invention.

Although the dispensing dryer 10 is illustrated as a front-loading dryer, the dispensing dryer may also be a top-loading dryer, as well as a combination washing machine and dryer; a tumbling or stationary refreshing/revitalizing machine; an extractor; a non-aqueous washing apparatus; and a revitalizing machine.

Examples of laundry for treatment by the dispensing dryer 10 include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be revitalized with the disclosed system and method. The fabric may have any fabric composition, examples of which include, but are not limited to, cotton, polyester, wool, silk, nylon, rayon, rubber, plastic, leather, and blends thereof.

Figure 2:
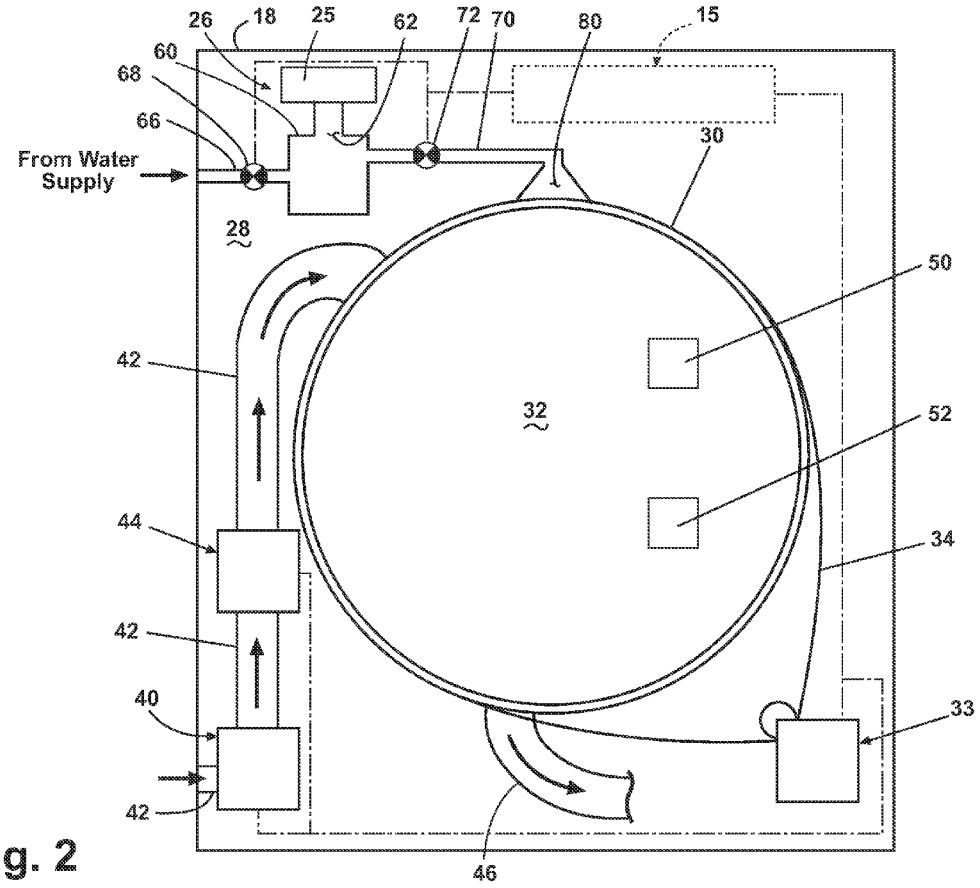
FIG. 2 is a schematic illustration of the interior of the dryer of FIG. 1 according to one embodiment of the invention.

FIG. 2 schematically illustrates an interior 28 of the dispensing dryer 10 having a rotating drum 30 with an open front for access to the interior of the drum 30 that defines a treating chamber 32 for holding laundry to be treated. The open front may be closed by the door 16 on the cabinet 12. Thus, access to the interior of the drum may be had through the door 16.

The cabinet 12 also encloses a drum motor assembly 33 configured for rotating the drum 30 via a drum belt 34, or alternately the motor assembly 33 may be directly coupled with the drum. A blower assembly 40, an inlet conduit 42, and a heater assembly 44 in fluid connection with one another and the treating chamber 32 are also enclosed by the cabinet 12. The conduit 42 fluidly connects the ambient air with the treating chamber 32. The blower assembly 40 and heater assembly 42 are located in-line with the conduit 42. Ambient air may be drawn in through the conduit 42 by the blower assembly 40 and directed through the treating chamber 32, where the air is heated and then sent into the treating chamber 32. An exhaust conduit 46 fluidly couples the treating chamber 32 to a standard exhaust fitting (not shown). Typically, the inlet conduit 42 may couple to a rear wall 19 of the treating chamber 32 and the exhaust conduit may couple to a front wall of the treating chamber and extend out the rear of the cabinet. However, other flow paths are possible as well as other arrangements of the blower assembly 40 and heater assembly 44. For example, the blower assembly may be located in the exhaust conduit 46.

The dispensing dryer 10 typically further comprises sensors 50, 52 configured to sense environmental conditions within the dispensing dryer 10. The sensors 50, 52 may be coupled to the rear wall 19 of the treating chamber 32 by any suitable means. Alternatively, the sensors 50, 52 can be positioned elsewhere in the treating chamber 32, inlet conduit 42, exhaust conduit 46, or heater assembly 40. The dispensing system 26 of the dispensing dryer 10 may be configured to dispense treating chemistry to laundry in the treating chamber 32.

In the embodiment shown in FIG. 2 and described herein, sensor 50 may be a wetness sensor, such as spaced conductivity strips, and sensor 52 may be a temperature sensor, such as a thermistor. The sensors 50, 52 are illustrated as being mounted on rear wall of the treating chamber so that the sensors 50, 52 may sense the environmental conditions within the treating chamber 32. Such a location also permits the sensors to contact laundry present in the treating chamber 32, which may be beneficial if the wetness sensor is spaced conductivity strips.

Alternatively, the sensors 50, 52 may be mounted at any location in or near the interior of the dispensing dryer 10 such that the sensors 50, 52 may sense directly or indirectly the desired environmental condition or a parameter that is indicative of, representative of, or related to the desired environmental condition. For example, in the case of the temperature sensor, the sensor may be located upstream or downstream of the treating chamber 32, and may be located in the exhaust conduit 46. While the sensed temperature may not be the exact temperature in the treating chamber 32, it may be indicative of the temperature in the treating chamber 32 or another parameter to be used for determining dispensing conditions. The wetness sensor may be also be located elsewhere in the dryer 10.

Although the dryer 10 is illustrated as having two sensors positioned on the rear wall 19, any number of sensors 50, 52 may be included in the dryer 10, and the sensors may be located at any suitable positions in the dryer 10. For example, two temperature sensors may be used to detect temperatures at two different points in the dryer, such as in the treating chamber 32 and in the exhaust conduit 46.

In other embodiments, a humidity sensor can be used in addition to or instead of either or both sensors 50, 52. The humidity sensor may be placed in or near the exhaust conduit 46 to sense a relative humidity of air exiting the treating chamber 32.

When used for sensing the wetness of the laundry, conductivity strips send a signal to the controller 15. This signal may include "hits," which occur each time a wet fabric article spans the conductivity strips to close the associated circuit. In a drying operation, the raw hit data may be processed to determine the validity of a hit. One method is to compare the number of hits during a predetermined time period to a reference value. If the hits within the time frame exceed a threshold value, then the hit data is considered valid. Illustrative examples of how the raw hit data is used to determine the dryness of the laundry may be found in U.S. Pat. Nos. 7,080,464; 6,446,357; and 6,199,300. In the case of determining the degree of wetness, the raw wet hit data may be used without the subsequent processing currently used for determining dryness. In this sense the wetness sensor 50 may be used to determine the relative or absolute degree of wetness of the clothes.

When used during a traditional drying cycle, the exhaust temperature over time, as sensed by the temperature sensor, has a fairly well-known profile. As heat is introduced over time during the drying cycle, the exhaust temperature initially tends to rise sharply at first, which corresponds to the heating of the clothes load to a temperature where the liquid starts to evaporate. The exhaust temperature then remains constant or has a generally constant slope as the water is evaporated from the clothes. When heat input exceeds the rate of evaporation for the remaining water, the exhaust temperature will start to quickly rise once again as not all of the heat is being used for evaporation. The transition from the constant temperature phase to the final quickly rising state is typically used as an indication that drying is complete.

Both sensors 50, 52 may be operably coupled to the controller 15 such that the controller 15 receives output from the sensors 50, 52. The controller 15 may be a microprocessor-based controller with digital memory for storing or making determinations from data obtained from the output of the sensors 50, 52. The controller 15 may also store the various drying cycles, including treating cycles, capable of being implement by the dryer. The controller 15 may be coupled to the control panel 14 to provide a user interface (not shown in FIG. 2) through which the consumer may interact with the controller 15 to select the desired cycle and its options as well as receiving information. The controller 15 may be also operably coupled to the dispensing system 26 to control the amount of treating chemistry dispensed as well as the manner of dispensing, such as whether the determined amount of treating chemistry may be dispensed all at once or at multiple times. The controller 15 may also control the other elements of the dispensing dryer 10 such that the controller 15 may be able to carry out a cycle of operation based on environmental conditions sensed by the sensors 50, 52.

The sensors 50, 52 may be used to determine the amount of treating chemistry dispensed, as well as the degree of wetness of the laundry. When used for dispensing, the output from the wetness sensor 50 and temperature sensor 52 may be processed in a manner different than when the data is used for drying. All things being equal, in the case of the conductivity sensor, as more treating chemistry is dispensed, the laundry should become more wet and the hit count should increase per unit of time. Generally, as more treating chemistry is dispensed, the exhaust temperature should drop and the temperature sensor 52 should send decreasing temperature signals over time to the controller. In both cases, the controller 15 may use the absolute increase and/or time rate of change increase of the wet hit data and/or the decreasing exhaust temperature data to determine the amount of treating chemistry that is dispensed.

Various thresholds in the data from the sensors 50, 52 may be established to control the dispensing of treating chemistry based on these sensed parameters. For example, various thresholds may signify a need to dispense less treating chemistry, a need to dispense more treating chemistry, and a need to start or stop dispensing treating chemistry. For example, the controller 15 may have access to a look-up table containing expected or desired output for a given set of parameters, certain treating chemistries, or a particular cycle of operation. The controller 15 may compare output data received from at least one of the sensors 50, 52 to values contained in the look-up table to determine whether more treating chemistry needs to be dispensed or if an appropriate amount of treating chemistry has been dispensed.

As used herein, the term environmental drying sensor refers to the wetness sensor 50 and temperature sensor 52, which have historically been used to determine when laundry is dry. Also as used herein, the term sensed environmental condition or parameter refers to the output of the environmental drying sensors and/or determinations made from the output by the controller 15.

In addition to controlling the amount of treating chemistry that is dispensed, the controller 15 may control the type of treating chemistry that is dispensed in the event that the dispenser 60 may dispense multiple treating chemistries. The controller 15 may also control that manner in which the amount of treating chemistry is dispensed. For example, controlling the duration of time during which treating chemistry is dispensed, and the number of dispensing periods during which treating chemistry is dispensed. The dispensing may comprise multiple dispensing periods. For example, the controller 15 could instruct a supply valve to open every 2 seconds for half-second dispensing periods over a total duration of 5 minutes.

The dispensing system 26 may be configured to deliver treating chemistry to the laundry as any one or combination of the following: a liquid (e.g., organized liquid, pure liquid dispensed in nanoparticulates or in encapsulated microparticles, and the like); a mist (e.g., droplets produced from a nebulizer, a sonifier, and the like); a fog; a vapor; a gas; a foam (either a wet or dry foam); a steam; a solid (e.g., powders, blocks, pouches, etc.); a semi-solid (e.g., paste, gel, viscoelastic material, etc.); capillary channels; microparticulates (e.g., nanoparticles, encapsulated microparticles, and the like); a microemulsion; an electrostatic dispersant (e.g., ionizations); multi-phase chemistries; or the like. A delivery medium including a fluid (e.g., a vapor, a mist, a fog, a foam, a steam, or a liquid) may use aqueous fluids, semi-aqueous fluids, non-aqueous fluids, or a mixture of these fluids.

The treating chemistry may comprise any suitable chemistries, examples of which include one or any mixtures of the following: water, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents.

In the exemplary embodiment illustrated in FIG. 2, the dispensing system 26 may have at least one reservoir 60, with a refill opening 62 in the top wall 18, which may be selectively closed by the lid 25. An optional water supply line 66 fluidly couples the reservoir 60 to a household water supply through water supply valve 68, which may be operably coupled to and controlled by the controller 15. A treating chemistry supply line 70 fluidly couples the reservoir 60 to the treating chamber 32 through optional dispenser nozzle 80. A control valve 72, which may be in the form of a pump, may be provided inline of the treating chemistry supply line 70 to control the dispensing of the treating chemistry from the reservoir 60. The valve 72 may be operably coupled to the controller 15 such that the controller 15 may control the dispensing of the treating chemistry by the actuation of the valve 72.

The reservoir 60 may be accessible to a user via the opening 62. The user may deposit a desired treating chemistry in the reservoir 60 by first opening the lid 25. The lid 25 may be any type of lid 25 enabling movement between an open position and a closed position uncovering and covering the opening 62, respectively. The lid 25 may be normally kept in the closed position covering the opening 62 to prevent the entrance of undesirable objects into the reservoir 60. When the lid 25 is manually moved to the open position uncovering the opening 62, the desired treating chemistry may be poured or otherwise manually deposited through the opening 62 and into the reservoir 60.

Although the reservoir 60 is illustrated as being a manual top-fill reservoir 60, the reservoir 60 may be any type of reservoir 60 configured to hold treating chemistry for application to laundry in the treating chamber 32. For example, the reservoir 60 could be a drawer-type reservoir that may be pulled outwardly from the cabinet 12 to be filled. The reservoir 60 may also be inaccessible to the user and filled with treating chemistry by treating chemistry supply lines (not shown) fluidly connected thereto. The reservoir may also be configured to receive one or more cartridges. In this way, if a different treating chemistry is desired, the user need only switch cartridges and need not waste the remaining treating chemistry.

The reservoir 60 may also be supplied with water via the water supply line 66. Water may or may not be supplied to the reservoir 60 and/or mixed with treating chemistry depending on the specific cycle of operation being carried out by the dryer 10. Depending on the cycle, water may be the treating chemistry, especially in a dewrinkling cycle.

In operation, the controller 15 may operate the treating chemistry supply valve 72 based on the wetness and temperature output received from one or both of the sensors 50, 52. Based on the output from at least one of the sensors 50, 52, the controller 15 determines the amount of treating chemistry that has been dispensed. When the amount of treating chemistry reaches the desired amount, such as a predetermined reference amount or within a reference range, for the selected cycle, the controller 15 will shut the valve 72 to stop dispensing. In this way, the controller 15 may control dispensing the chemistry based on the desired amount to be dispensed for the selected cycle, instead of based on the time of delivery as has been previously done.

During the cycle of operation, output generated by the sensors 50, 52, as well as output generated by additional sensors, may be utilized to generate digital data corresponding to sensed environmental conditions. For example, the wetness sensor 50 generates output indicative of the moisture content of the laundry present in the treating chamber 32, while the temperature sensor 52 generates output indicative of the temperature of the laundry present in the treating chamber 32. This output may be sent to the controller 15 for use in calculating environmental conditions. Once the output has been received, the controller 15 may processes the output, store the processed information in memory, or store the unprocessed output in the memory for subsequent use. The controller 15 may convert the output during processing such that it may be properly stored in the digital memory as digital data. The stored digital data may be processed in a buffer memory, and used, along with preselected coefficients, in algorithms to electronically calculate various environmental parameters for wetness and temperature, such as, for example, a degree of wetness, difference in wetness, time rate of change in wetness, temperature, difference in temperature, and/or time rate of change in temperature of the laundry. The preselected coefficients may be selected based on the type of treating chemistry being dispensed if the treating chemistry type is provided to the controller 15, for example, by an RFID associated with the treating chemistry.

Figure 3:
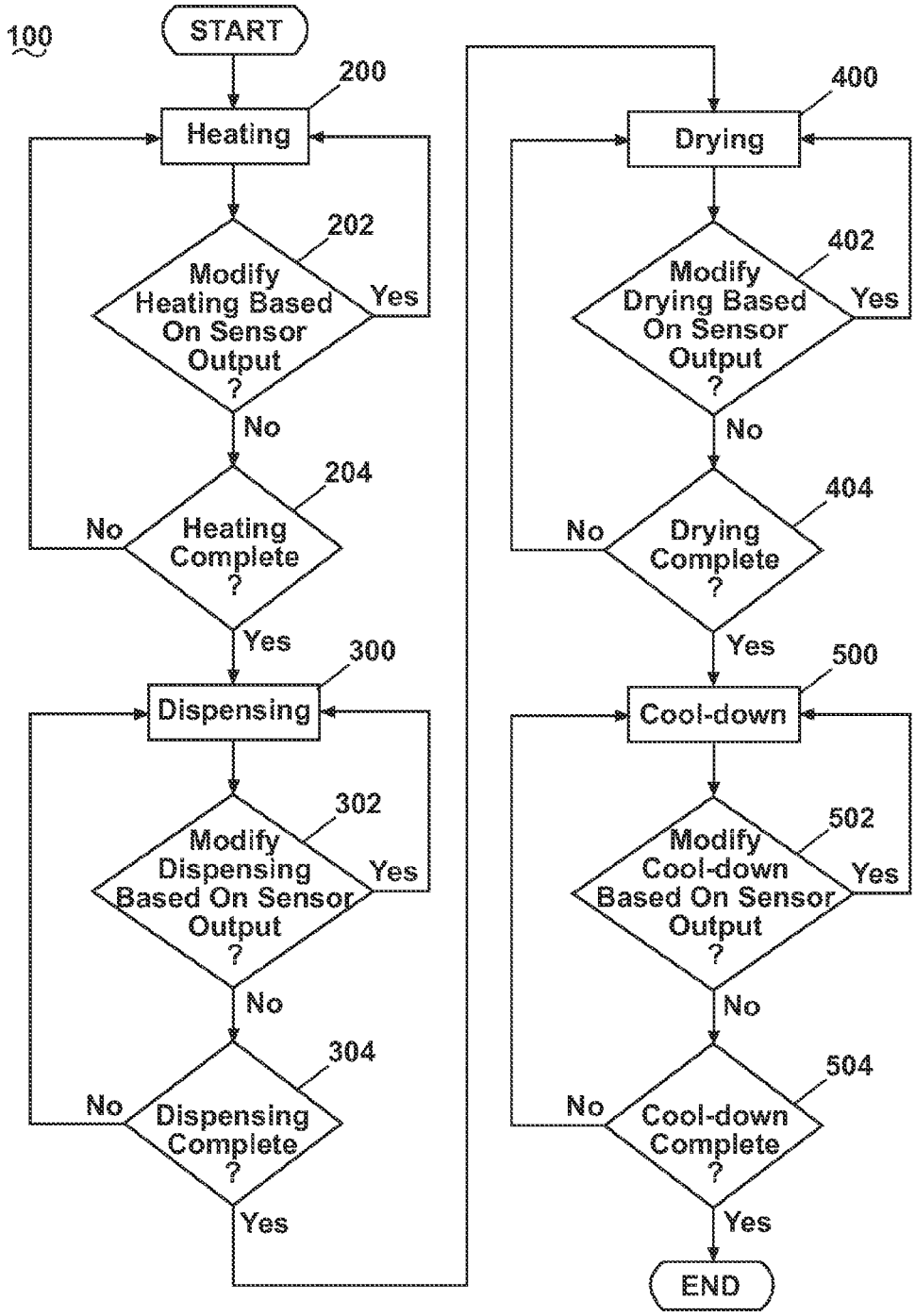
FIG. 3 is a flow chart illustrating an exemplary cycle of operation to be carried out by the dispensing dryer of FIGS. 1 and 2 according to one embodiment of the invention.

For example, as discussed previously, conductivity strips typically output analog data representative of each time wet laundry contacts the strip to complete an electrical circuit or produce a hit. The wetness parameters may be determined by evaluating the hits over a single or multiple duty cycles, with the duty cycle being selected by the controller or pre-programmed. A temperature parameter of the laundry may be determined by evaluating the different levels of resistance, which may be found using the digital data obtained from the thermistor's output. A flow chart of an exemplary cycle of operation 100 according to one embodiment of the invention is provided in FIG. 3. This cycle is one of many and is just for illustration purposes. Other cycles of operation implemented by the dispensing dryer 10 may include more or fewer steps than the cycle of operation depicted by the control chart 100. Other cycles may use more, less, or other combinations of the wetness and temperature parameters. For purposes of simplifying the illustration, only the degree of wetness parameter will be used, with it being understood that it may apply to other environmental conditions or parameter or combinations thereof.

A user first selects a desired cycle of operation by means of the control panel 14. Typically, the dispensing dryer 10 will offer the user a number of pre-programmed cycles of operation to choose from, and each pre-programmed cycle of operation may have any number of adjustable parameters. The cycle of operation may be a treating cycle, a conventional drying cycle, a drying cycle in combination with a treating cycle, or any other cycle of operation provided by the dispensing dryer 10.

In accordance with the parameters specified by the user and input at the control panel 14, the various components of the dryer will start the cycle of operation. Throughout the cycle, the operational status of the dryer 10 may be reflected on the control panel 14 so as to visually inform the user of the status of the dryer 10, or to request that the user interact with the dryer 10 (e.g. request the user to fill the reservoir 60 with treating chemistry).

After the user has loaded laundry into the treating chamber 32 of the dispensing dryer 10, the controller 15 may use both the parameters specified by the user and the additional information obtained by the sensors to carry out the desired cycle of operation. The exemplary control process illustrated in FIG. 3, which is a combination treating cycle and drying cycle, begins with a heating step 200 during which heat may be applied to the laundry in the treating chamber 32. The heating step 200 is optional. Some treating chemistries require a certain temperature to activate or are more effective at a certain temperature. Depending on the type of treating chemistry being used, the heating step 200 may be used to raise the temperature of the laundry to a temperature suitable for activating the treating chemistry or providing the best environment for the treating chemistry. During the heating step 200, the laundry may also be tumbled. The controller 15 receives temperature data from the sensor 52 and compares it to a reference temperature for the selected cycle and treating chemistry. If the temperature does not satisfy the reference value, the controller 15 at step 202 may adjust various parameters of the cycle of operation in order to achieve the desired heating environmental conditions and optimize the cycle of operation. For example, if the cycle of operation specified by the user calls for the temperature of the laundry in the treating chamber 32 to be raised to 200° F. in a 5-minute time span, and the sensed temperature is only 100° F. after 5 minutes, the controller 15 may continue heating the laundry and/or increase the duty cycle of the heater assembly 44 in order to bring the laundry to the desired temperature as quickly as possible. The steps of heating 200 and modification 202 are repeated until the heating is complete in step 204.

Upon completion of the heating at step 204, a dispensing step 300 begins. During the dispensing step 300, the controller 15 operates the dispensing system 26 to dispense treating chemistry to the laundry in the treating chamber 32. The step 300 may comprise initially dispensing a predetermined amount of treating chemistry to the laundry based on cycle parameters and subsequently dispensing one or multiple amounts of treating chemistry to the laundry based on a sensed degree of wetness of the laundry. The laundry may also be tumbled, heated, or otherwise treated during the dispensing step 300.

At step 302, the controller 15 receives the wetness data from the sensors 50. The controller may use this information to set initial values for the degree of wetness, especially if a change in the degree of wetness indicates when dispensing is complete. The controller 15 also receives the wetness data to determine the change in the degree of wetness, absolute degree of wetness, or the time rate of change in the wetness. If the sensed degree of wetness is not indicative of sufficient dispensing, which can be determined by comparing sensed parameters to expected or desired parameters contained in the look-up table, the controller 15 may adjust various parameters of the cycle of operation in order to achieve the desired dispensing environmental conditions and optimize the cycle of operation. This can be accomplished as discussed previously by adjusting the duration, number, and/or rate of applications of the treating chemistry, or by starting or stopping application for the treating chemistry. Control then passes back to step 300 for continued dispensing.

If, at step 302, no modifications to the dispensing method are warranted, then control passes to step 304 to determine if the dispensing is complete. If the sensed degree of wetness is indicative of an appropriate amount of treating chemistry being dispensed, the dispensing is complete and control passes to a standard drying cycle in step 400.

The drying step 400 may be used to dehydrate the laundry using heat from the heater assembly 44 and air from the blower assembly 40. During the drying step 400, the laundry may also be tumbled. In the drying step 400, the controller 15 uses the output from the drying sensor 50 and temperature sensor 52 to determine when the laundry has reached the desired degree of wetness in the manner previously described.

Examples of which include comparing the hit count to a predetermined reference value for the selected cycle and/or monitoring the exhaust temperature for the change from the constant temperature phase to the second temperature increasing phase. Typically, the hit count is tracked for the initial portion of the drying cycle and is used to set an overall drying time where heat is added to effect the drying of the laundry. The temperature may also be monitored to determine if the exhaust temperature exceeds a predetermined threshold that prevents damage to the laundry.

At step 402, the drying step may be modified based on the sensed wetness and temperature data. For example, the drying time may be adjusted during the drying cycle based on the sensed wetness and temperature data. As the expiration of the drying time nears, a new determination of wetness may be made. If it indicates that laundry is not drying as quickly as anticipated, the drying time may be increased or the heater duty cycle can be increased. Also, if the temperature exceeds a reference temperature, the duty cycle of the heater may be changed to reduce the overall heat output.

If no drying changes need be made at step 402, control passes to step 404 where a determination is made of whether the drying is complete. An example includes the expiration of the drying time.

At the completion of the drying step 400, control passes to a cool-down step 500. The cool-down step 500 typically involves rotating the drum while passing unheated air through the treatment chamber until the exhaust temperature reaches a reference value indicative of the laundry being cooled. However, this may be a time-based step where the drum rotates for a reference time while unheated air is passed through the treating chamber.

At step 502, a determination may be made regarding whether the cool-down step should be modified. For example, in the case where the dryer has a variable speed motor, it may be desirable to change the air flow rate to obtain the desired rate of cooling.

If no changes are desired at step 502, a test is made a step 504 to determine if the cool down is complete. As previously described, examples of this test may be the reducing of the exhaust temperature to a reference temperature or it may be the expiration of the reference time period.

The relationship between the traditional sensors and the controller in the inventive method provides the ability to optimize operation of the dispensing dryer 10. The controller can minimize cycle length by optimizing operation of the dispensing dryer 10 at each step during the cycle of operation. For example, the first temperature, second temperature, first degree of wetness, and second degree of wetness can be selected by the controller so as to minimize the overall duration of the cycle of operation.

As may be seen by the example, a benefit of the invention is that the dispensing of a treating chemistry in a dispensing dryer may be controlled by the sensors traditionally used to control the drying of the laundry load, eliminating the need for specialized sensors tailored for the specific treating chemistry.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for controlling an operation of a clothes dryer having a treating chamber, an environmental drying sensor for sensing an environmental condition in the treating chamber and used to control the drying of the clothes, a controller operably coupled to the environmental drying sensor for controlling a drying cycle based on the sensed environmental condition, and a dispensing system for dispensing a treating chemistry to the treating chamber, the method comprising:

determining, by the controller, an activation or effective temperature of a treating chemistry in the dispensing system;

heating the laundry during a heating phase to a reference temperature corresponding to the determined activation or effective temperature of the treating chemistry;

providing an output from the environmental drying sensor to the controller indicative of the temperature of the laundry during the heating phase;

cooling the laundry during a cool-down phase subsequent to the heating phase to a predetermined temperature; and comparing the output with the reference temperature and dispensing the treating chemistry to the laundry when the output satisfies the reference temperature.

2. The method according to claim 1 wherein the dispensing comprises controlling a quantity of treating chemistry dispensed based on the output from the environmental drying sensor.

3. The method according to claim 1 wherein the dispensing comprises controlling a type of treating chemistry dispensed based on the output from the environmental drying sensor.

4. The method according to claim 1 wherein the dispensing comprises controlling a duration of treating chemistry dispensed based on the output from the environmental drying sensor.

5. The method according to claim 4 wherein the duration comprises multiple dispensing periods.

6. The method according to claim 5 wherein the dispensing comprises determining an amount of treating chemistry dispensed and the duration for each of the multiple dispensing periods.

7. The method according to claim 4 wherein the dispensing comprises determining an amount of treating chemistry to be dispensed.

8. The method according to claim 7 wherein the dispensing comprises determining a duration of the dispensing step.

9. The method according to claim 1 and further comprising terminating the heating phase based on an output from the environmental drying sensor.

10. The method according to claim 1 wherein the treating chemistry is selected from at least one of water, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents.

11. The method according to claim 1, further comprising drying the laundry during a drying phase where the laundry is tumbled within the treating chamber while heated air is supplied to the treating chamber to heat the laundry and evaporate liquid from the laundry.

* * * * *